US006300293B1

(12) United States Patent
Lamberth

(10) Patent No.: US 6,300,293 B1
(45) Date of Patent: Oct. 9, 2001

(54) LUBRICANT COMPOSITION FOR METAL WORKING OPERATIONS

(75) Inventor: Curt Lamberth, Oxford (GB)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/462,531

(22) PCT Filed: Jul. 13, 1998

(86) PCT No.: PCT/GB98/02054

§ 371 Date: Apr. 3, 2000

§ 102(e) Date: Apr. 3, 2000

(87) PCT Pub. No.: WO99/03956

PCT Pub. Date: Jan. 28, 1999

(30) Foreign Application Priority Data

Jul. 17, 1997 (GB) ..... 9714997

(51) Int. Cl.[7] ..... C10M 141/10; C10M 141/02

(52) U.S. Cl. ..... 508/436; 508/485

(58) Field of Search ..... 508/485, 380, 508/436

(56) References Cited

U.S. PATENT DOCUMENTS

| | | | | |
|---|---|---|---|---|
| 4,031,019 | * | 6/1977 | Bell | 508/485 |
| 4,178,260 | * | 12/1979 | Cook et al. | 508/485 |
| 4,637,885 | * | 1/1987 | Kuwamoto et al. | 508/485 |
| 5,773,391 | * | 6/1998 | Lawate et al. | 508/491 |
| 5,798,322 | * | 8/1998 | Brannen et al. | 508/493 |
| 5,994,278 | * | 11/1999 | Duncan et al. | 508/485 |

* cited by examiner

*Primary Examiner*—Jacqueline V. Howard
(74) *Attorney, Agent, or Firm*—Joseph J. Allocca

(57) ABSTRACT

The lubricant composition comprises (a) a paraffinic base oil of defined viscosity and evaporation rate characteristics, (b) a polyhydric alcohol/aliphatic acid ester, and (c) an antiwear agent. The lubricant composition is especially suitable for use in punching and staged-drawing operations on a metal/alloy, e.g. steel.

14 Claims, No Drawings

LUBRICANT COMPOSITION FOR METAL WORKING OPERATIONS

This application is a 371 of PCT/GB98/02054, filed Jul. 13, 1998.

This invention relates to a lubricant composition for use in metal working operations; more especially for use in metal-deforming processes, such as, for example, punching, pressing, forming and drawing processes. The invention is especially useful when the metal involved in such a process is iron or an iron-containing alloy or is aluminium.

In such metal-deforming processes, especially severe operations on aluminium and steels, the lubricant employed must have the ability to lubricate fully throughout the process. An example of a severe operation is a three stage forming/drawing operation using mild steel to form a cylinder 14.0 cm diameter, and 22.9 cm long. This process is normally lubricated with a lubricant at an operating temperature of 40 to 70° C. However, known lubricants result in substantial amounts of residue depositing on the formed/drawn metal-product, which product then has to be cleaned or degreased before it can pass to a further processing step, such as painting or dip-varnishing.

It is an object of the present invention to provide a lubricating composition suitable for use in metal or metal alloy deforming processes, which composition has significantly decreased residue-forming characteristics while still retaining good lubricity characteristics.

According to one aspect of the present invention there is provided a lubricant composition suitable for use in a metal or metal alloy deforming process, which composition comprises:

(i) a major proportion by weight of an essentially paraffinic base oil having a viscosity at 25° C. (ASTM D 445) of 2.00 to 2.75 $mm^2/s$ and an evaporation rate (DIN 53170) of from 400 to 700, (on a scale where diethyl ether=1);

(ii) a minor proportion by weight of a polyhydric alcohol ester of an aliphatic acid;

(iii) an amount by weight, which is less than that of (ii), of an antiwear agent; and (iv) from 0 up to 10/% by weight of an antioxidant.

Preferably, the base oil component (i) is essentially isoparaffinic. The preferred viscosity range for the base oil is preferably 2.00 to 2.60 $mm^2/s$, very preferably from 2.25 to 2.60 $mm^2/s$. The viscosities are, as previously stated, measured at 25° C. A base oil component (i) used in the invention of viscosity of 2.44 $mm/s^2$ at 25° C., will have a viscosity of 1.85 $mm/s^2$ at 40° C. A typical commercial spindle oil has a minimum viscosity at 40° C. of 10 $mm^2/s$, whilst a typical commercial cylinder oil has a viscosity in the broad range 30 to 50 $mm^{2/}s$ at 40° C.

The preferred said evaporation rate is from 450 to 700, more especially 600 to 700. Normally, the base oil is present in an amount of at least 75 wt. %; preferably at least, 80 wt. % or 90 wt. % or 95 wt. %, according to the process for which the composition is intended.

The said ester component (ii) is preferably an oleic acid ester. The polyhydric alcohol moiety is normally pentaerythritol. Pentaerythritol tetraoleate (PETO) is a preferred component (ii). The ester component can be present in an amount up to 15 wt. %, or up to 10 wt. %, more usually up to 5 wt. %.

The antiwear agent, component (iii) may be, for example, zinc dithiophosphate (ZnDTP) or other known agent. Preferably, it is an amine neutralised phosphoric acid ester of at least one aliphatic alcohol, especially an aliphatic amine neutralised such ester. Noramlly, up to 2.5wt. % of component (iii) is employed (but less than component (ii)). The wt. % ratio of components (ii) and (iii) is, preferably, from 1.5:1 to 10:1, suitably 2:1 to 8:1.

Optionally the lubricant according to the invention may include up to 1 wt. % of an antioxidant, suitably up to 0.5 wt. %, or up to 0.2 wt. %. This component may be any suitable known antioxidant, preferably 2,6-di-tert butyl 4-methyl phenol.

In accordance with another aspect, the invention provides a concentrate suitable for use in preparing a lubricating oil composition-defined above; which concentrate comprises a solution or dispersion in a base oil defined above, of (a) a polyhydric alcohol ester of an aliphatic acid, (b) a lesser amount of an antiwear agent, preferably being an amine neutralised phosphoric acid ester of at least one aliphatic alcohol and, optionally, (c) an antioxidant; (a) and (b) being present in a weight ratio of from 1.5:1 to 10:1, preferably 2:1 to 8:1.

In accordance with a still further aspect, the invention provides a metal deforming process, more especially a steel deforming process, employing as the, or a, lubricant, a composition defined above or prepared from a concentrate defined above. The deforming process may be, for example, metal-punching a steel sheet. A preferred lubricant composition of the invention for use in such a process contains constituents (ii) and (iii) in total amount of 1 to 2 wt. % and in ratio 1.5:1 to 3:1. For use in another deforming process, viz. two-stage steel-drawing process, a preferred lubricant contains constituents (ii) and (iii), in total amount of 10 to 20 wt. % and in ratio 2:1 to 8:1.

Some comparative tests were made between two commercially available metal working lubricant compositions (A and B), and a composition (C) which is one in accordance with the present invention. Compositions A and C are mineral oil based and composition B is synthetic ester based. Components and characteristics of these compositions are given in Table I.

The three compositions were subjected to thermogravimetric analysis (TGA). The TGA was conducted under nitrogen in three steps (a) up to 125° C. at 5° C. per min. (b) held at 125° C. for 20 min. and (c) from 125 to 300° C. at 5° C per min. Residue % was measured.

The results of the tests are shown in Table II.

It will be seen from Table II that the TGA residue % from composition C is very much lower than those from the known compositions. This illustrates substantial superiority for the composition of the invention under the practical conditions of severe metal-deformation processes. The resulting metal product will require no, or very significantly less, cleaning or degreasing before being ready for a further processing step e.g. painting or varnishing. One contributing factor for said superiority is illustrated in Table II by step (a) of the TGA test. There has been appreciably more evaporation of the oil in composition C (the invention) over the temperature range up to 125° C.

The invention includes, in a further aspect, the use of lubricant compositions as herein defined in a metal working process, including the metal-deforming processes generally and particularly referred to herein. One such process is a two-stage metal-drawing process. That two-stage process is not possible with the foregoing compositions A and B. The latter provide insufficient lubrication throughout the full process, leading to case-splitting.

TABLE I

| | The Compositions | | |
|---|---|---|---|
| | A | B | C |
| Base Oil Viscosity @ 25° C. ($mm^2/s$) | <1.70 | <2.40 | 2.44 |
| Evaporation Rate (diethyl ether = 1) | 400 to 500 | 500 to 600 | 650 to 700 |
| Additives | | | |
| Ca phenate | YES) ) 4.5% | NIL | NIL |
| Zn DTP | YES) ) in | NIL | NIL |
| PETO | NIL) ) total | NIL | YES) 1.5 wt. % ) in |
| Antiwear Agent | ZnDTP) | NIL | (iii) herein) total |

TABLE II

| | The Results | | |
|---|---|---|---|
| | A | B | C |
| TGA % step (a), up to 125° C., % evaporated | 94.6 | 88.4 | 98.2 |
| TGA % residue | 3.40 | 11.09 | 1.12 |

What is claimed is:

1. A lubricant composition suitable for use in a metal or metal alloy deforming process, which composition comprises:

(i) at least 75% by weight of an essentially paraffinic base oil having a viscosity at 25° C. as determined by ASTM D 445 of 2.00 to 2.75 $mm^2/s$ and an evaporation rate as determined by DIN 53170 of from 400 to 700, on a scale where diethyl ether=1;

(ii) a major proportion by weight of a polyhydric alcohol ester of an aliphatic acid;

(iii) an amount by weight, which is less than that of (ii), of an amine neutralized phosphoric acid ester of at least one aliphatic alcohol as antiwear agent, the weight ratio of (ii) to (iii) being from 1.5:1 to 10:1; and (iv) from 0 up to 1% by weight of an antioxidant.

2. A composition as claimed in claim 1, wherein the base oil has a said viscosity of from 2.25 to 2.60 $mm^2/s$.

3. A composition as claimed in claim 2, wherein the base oil has a said evaporation rate of from 600 to 700.

4. A composition as claimed in 3, wherein component (ii) is pentaerythritol tetraoleate.

5. A composition as claimed in claim 4, wherein component (iv) is 2,6-di-tert butyl 4-methyl phenol.

6. A composition as claimed in claim 4, wherein the base oil is present in an amount of at least 80 wt. %.

7. A composition as claimed in 4, wherein component (ii) is present in an amount up to 15 wt. %.

8. A composition as claimed in claim 7, wherein component (iii) is present in an amount up to 2.5 wt. %.

9. A composition as claimed in claim 8, wherein the weight ratio of components (ii) and (iii) is from 2:1 to 8:1.

10. A concentrate suitable for use in preparing a lubricating oil composition which concentrate comprises a solution or dispersion, in a paraffinic base oil, having a viscosity at 25° C. of 2.00 to 2.75 $mm^2/s$ as determined by ASTM D 445 and an evaporation rate of from 400 to 700 as determined by DIN 53170, on a scale when diethyl ether=1, of an amount of (a) a polyhydric alcohol ester of an aliphatic acid, (b) a lesser amount of an amine neutralised phosphoric acid ester of at least one aliphatic alcohol, (a) and (b) being present in a weight ratio of from 1.5:1 to 10:1.

11. A metal deforming process employing as the lubricant, the composition of claim 1, 6 or 9.

12. The concentrate of claim 10 wherein (a) and (b) are present in the weight ratio of 2:1 to 8:1.

13. The concentrate of claim 10 wherein (a) is pentaerythritol tetraoleate, (b) is an aliphatic amine neutralized phosphoric acid ester of at least one aliphatic alcohol, the concentrate including an antioxidant.

14. The concentrate of claim 13 wherein the antioxidant is 2,6-di-tert butyl 4-methyl phenol.

* * * * *